US010245567B2

(12) United States Patent
Kaartinen

(10) Patent No.: US 10,245,567 B2
(45) Date of Patent: Apr. 2, 2019

(54) MIXING AND DELIVERY METHOD ARRANGEMENT AND PUMP FOR SUPPLYING SMALL PARTICLES SUSPENDED IN A LIQUID TO FORM SLURRY FOR DELIVERY

(71) Applicant: OUTOTEC (FINLAND) OY, Espoo (FI)

(72) Inventor: Jani Kaartinen, Kuopio (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/532,758

(22) PCT Filed: Dec. 10, 2015

(86) PCT No.: PCT/FI2015/050869
§ 371 (c)(1),
(2) Date: Jun. 2, 2017

(87) PCT Pub. No.: WO2016/092155
PCT Pub. Date: Jun. 16, 2016

(65) Prior Publication Data

US 2017/0361288 A1 Dec. 21, 2017

(30) Foreign Application Priority Data

Dec. 12, 2014 (FI) ..... 20146087

(51) Int. Cl.
*B01F 5/10* (2006.01)
*B01F 7/00* (2006.01)
(Continued)

(52) U.S. Cl.
CPC ..... *B01F 5/108* (2013.01); *B01F 5/104* (2013.01); *B01F 7/00358* (2013.01);
(Continued)

(58) Field of Classification Search
CPC ..... B01F 5/108; B01F 5/104; B01F 7/063; B01F 7/1635; B01F 7/1645; B01F 7/00358
(Continued)

(56) References Cited

U.S. PATENT DOCUMENTS 4,347,004 A * 8/1982 Platts ..... B01F 5/104 366/137
4,497,580 A 2/1985 Doyel
(Continued)

FOREIGN PATENT DOCUMENTS

FR 1475576 A * 3/1967 ..... B01F 7/00358
FR 2 402 471 A1 4/1979

OTHER PUBLICATIONS

International Search Report issued by the European Patent Office acting as the International Searching Authority in relation to International Patent Application No. PCT/FI2015/050869 dated Mar. 18, 2016 (4 pages).
(Continued)

*Primary Examiner* — Marc C Howell
(74) *Attorney, Agent, or Firm* — Robert P. Michal, Esq.; Carter, DeLuca & Farrell LLP

(57) ABSTRACT

A mixing arrangement, and pump for supplying small particles suspended in a liquid to form slurry for delivery includes a container, a mixing and delivery pump having a first shaft, a rotor connected to the first shaft and arranged at an inner bottom of an inner space of the container, a first power device connected to the first shaft, and a stator having stator blades. The stator surrounds the first shaft. The arrangement includes a pump having an inlet, which is located in a stator space between two stator blades, and an
(Continued)

outlet, and an outlet pipe having a second inlet opening connected to the outlet and a second outlet opening located outside the inner space.

7 Claims, 15 Drawing Sheets

(51) Int. Cl.
*B01F 15/00* (2006.01)
*B01F 15/02* (2006.01)
*B01F 3/12* (2006.01)

(52) U.S. Cl.
CPC .... *B01F 7/00375* (2013.01); *B01F 15/00012* (2013.01); *B01F 15/00207* (2013.01); *B01F 15/00915* (2013.01); *B01F 15/0283* (2013.01); *B01F 2003/1285* (2013.01)

(58) Field of Classification Search
USPC ..... 366/136, 190
See application file for complete search history.

(56) References Cited

U.S. PATENT DOCUMENTS

| | | | | |
|---|---|---|---|---|
| 4,499,562 | A | 2/1985 | Campolini et al. | |
| 5,005,364 | A | 4/1991 | Nelson | |
| 8,517,598 | B1 * | 8/2013 | Lowell ..... | B01F 15/00883 366/307 |

OTHER PUBLICATIONS

Written Opinion of the International Searching Authority issued by the European Patent Office acting as the International Searching Authority in relation to International Patent Application No. PCT/FI2015/050869 dated Mar. 18, 2016 (6 pages).

Notification of the Necessity to Present Additional Materials issued by the Eurasian Patent Organization in relation to Eurasian Application No. 201791116/31 (3 pages) and English language translation (3 pages).

* cited by examiner (A-A FIG 2):

MIXING AND DELIVERY METHOD ARRANGEMENT AND PUMP FOR SUPPLYING SMALL PARTICLES SUSPENDED IN A LIQUID TO FORM SLURRY FOR DELIVERY

CROSS REFERENCE TO RELATED APPLICATIONS

This application is a National Phase Entry under 35 USC § 371 of PCT Patent Application Serial No. PCT/FI2015/050869 filed Dec. 10, 2015, which claims priority to Finnish Patent Application No. 20146087, filed Dec. 12, 2014, the disclosure of each of these applications is expressly incorporated herein by reference in their entirety.

FIELD OF THE INVENTION

The invention relates to a mixing and delivery method for supplying small particles suspended in a liquid to form a slurry for delivery.

The invention also relates to a mixing and delivery arrangement for supplying small particles suspended in a liquid to form a slurry for delivery.

The invention also relates to a mixing and delivery pump for supplying small particles suspended in a liquid to form a slurry for delivery.

OBJECTIVE OF THE INVENTION

The object of the invention is to provide a mixing and delivery method, arrangement and mixing and delivery pump for supplying small particles suspended in a liquid to form a slurry for delivery which provides for uniform distribution of small particles.

LIST OF FIGURES

Figure 1:
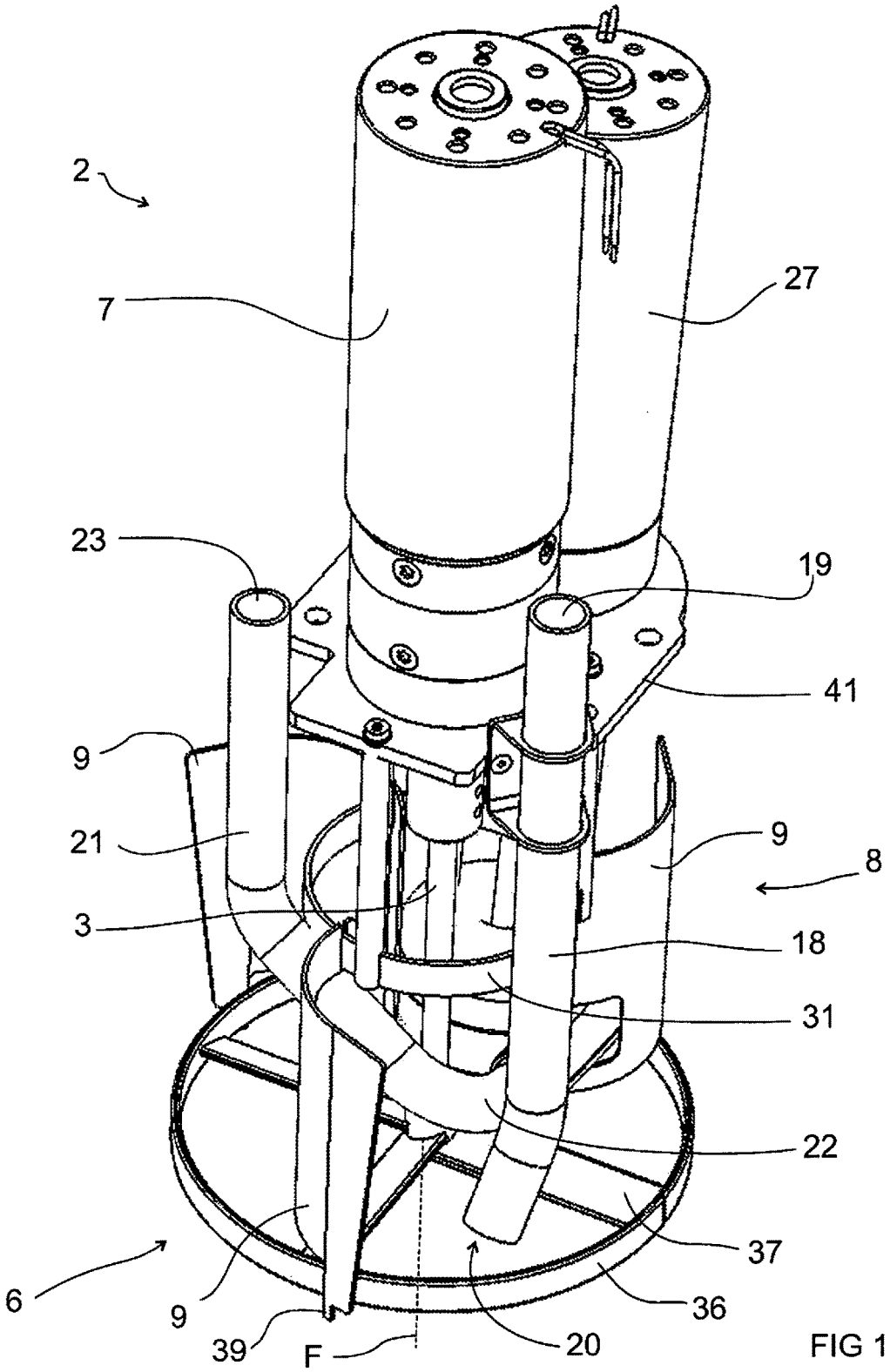
Figure 2:
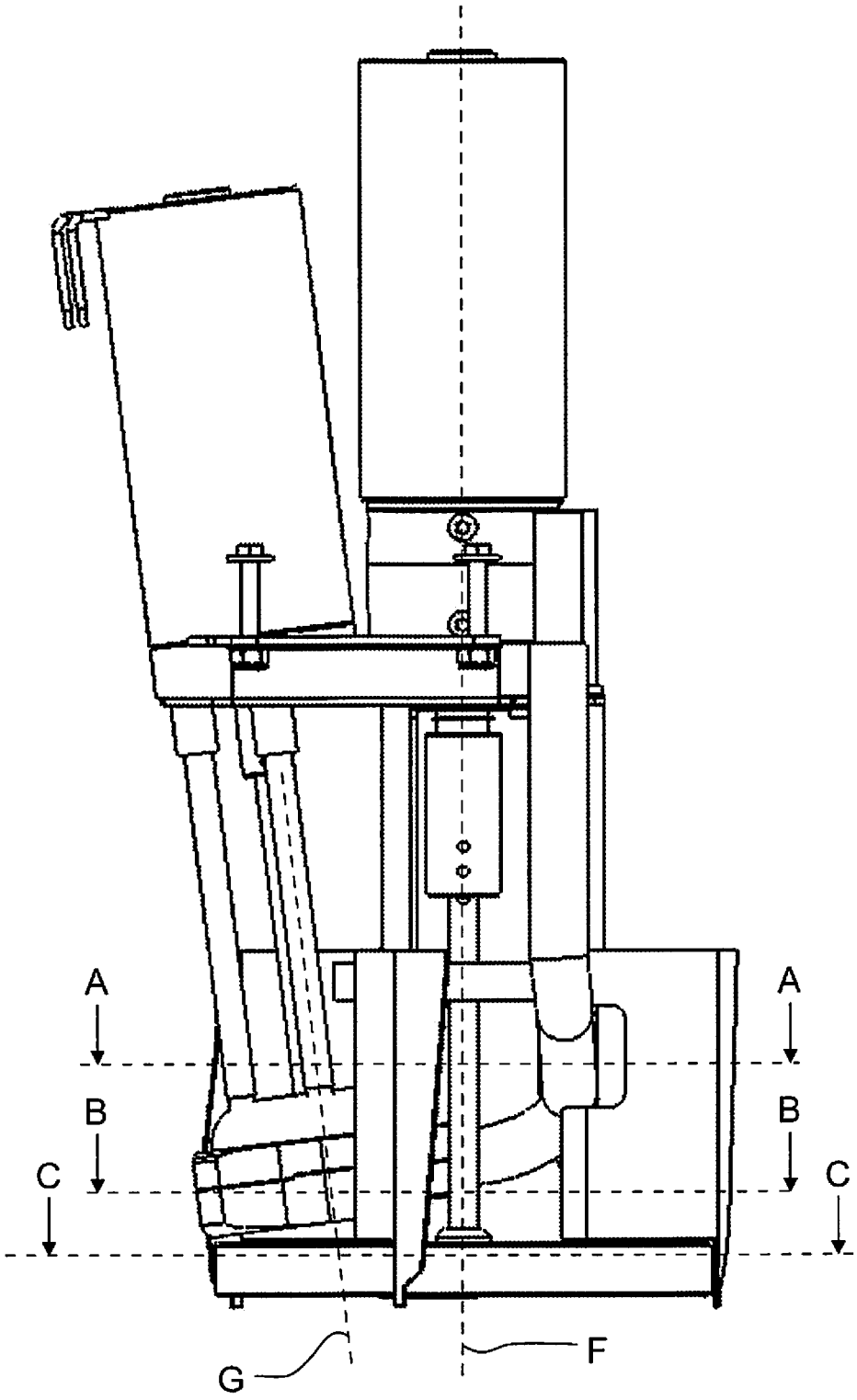
Figure 3:
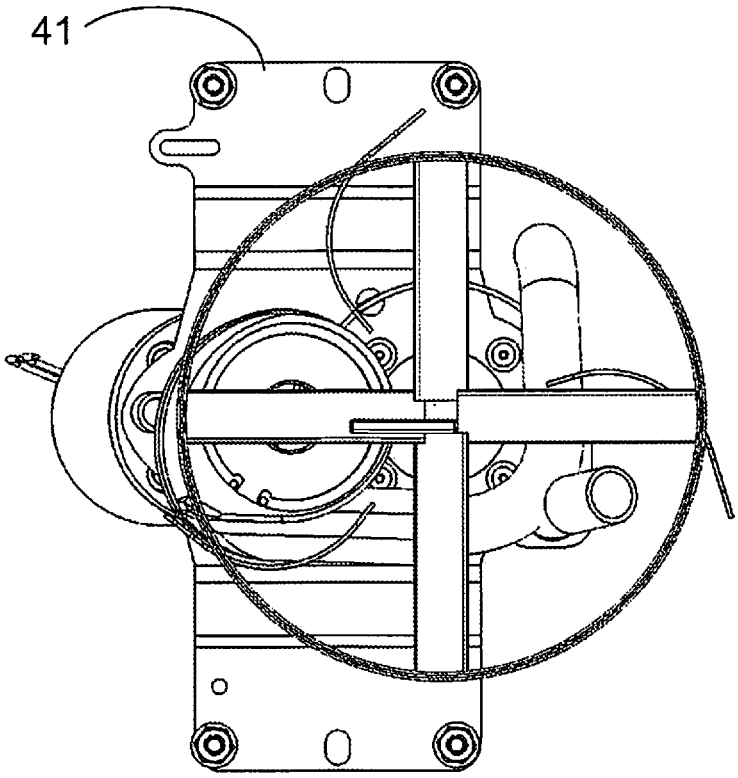
Figure 4:
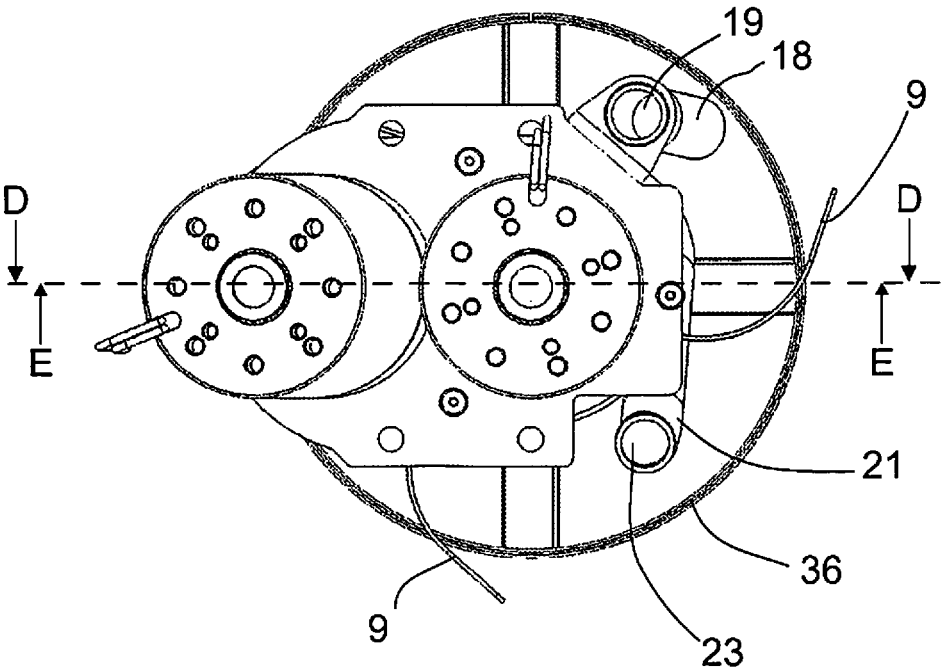
Figure 5:
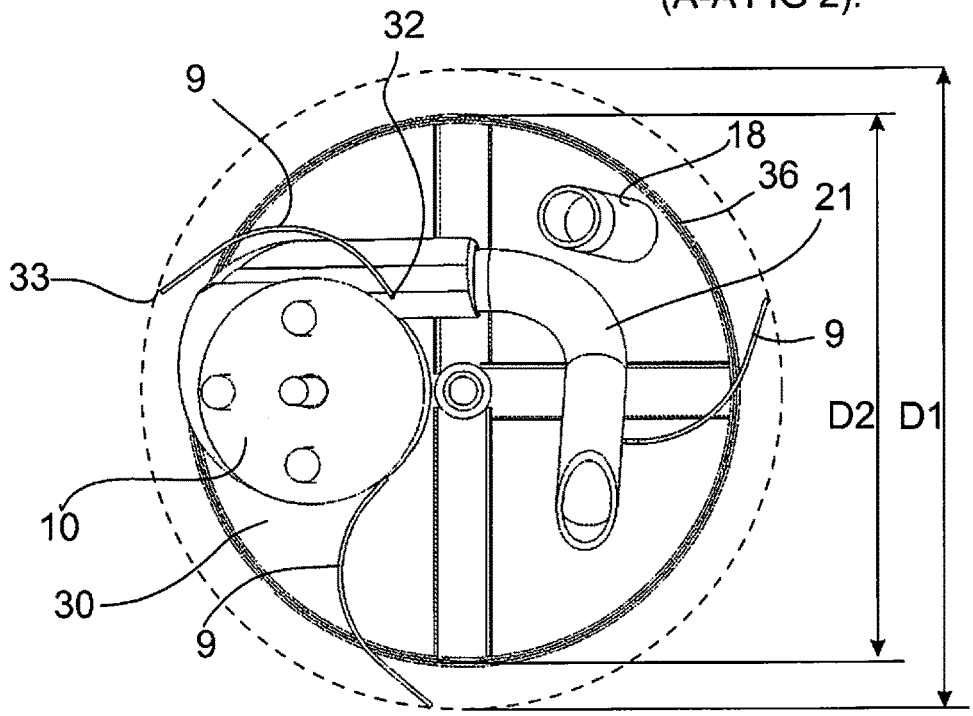
Figure 6:
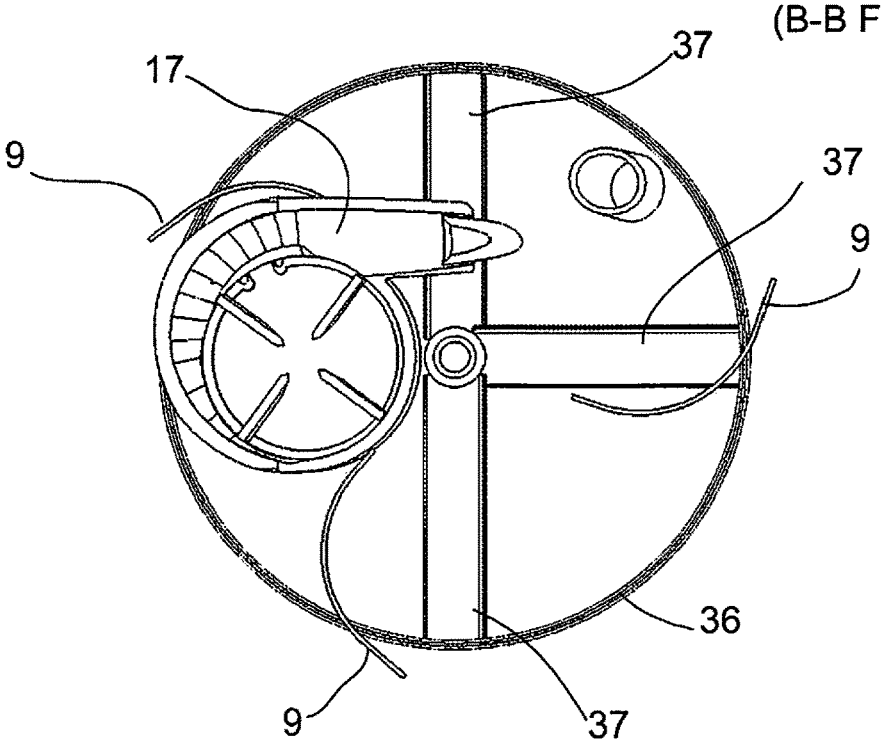
Figure 7:
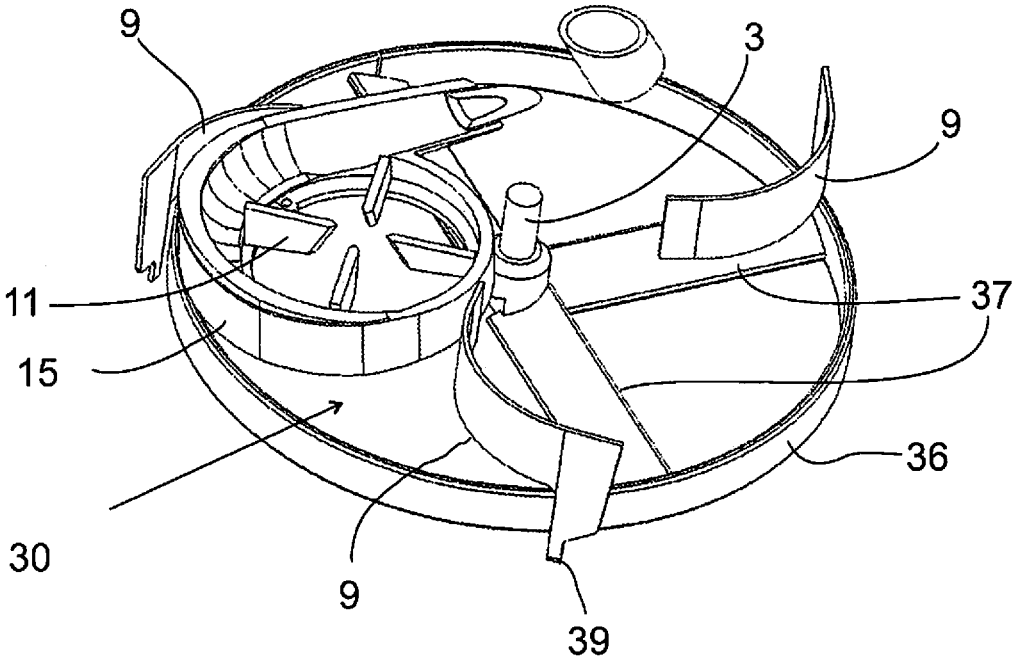
Figure 8:
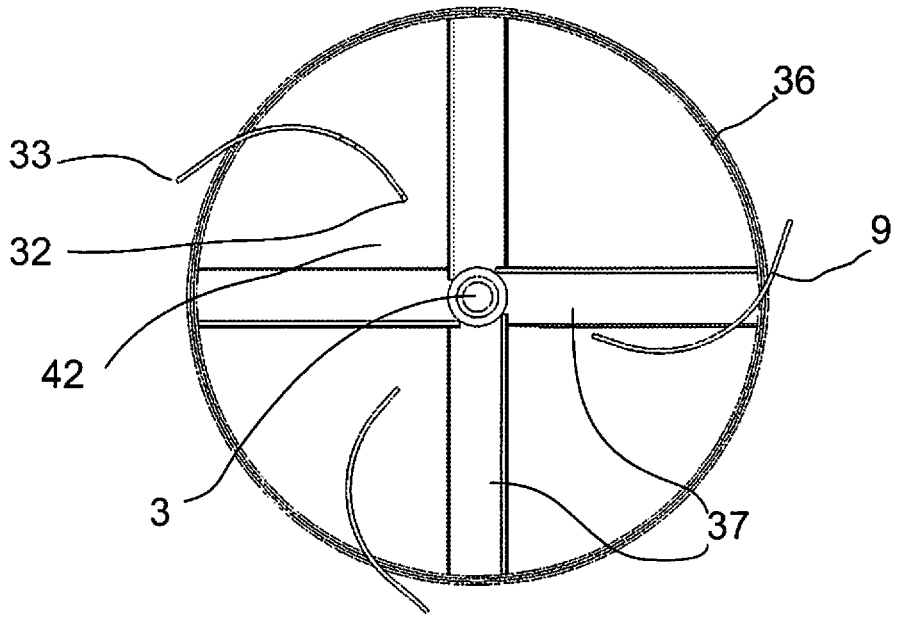
Figure 9:
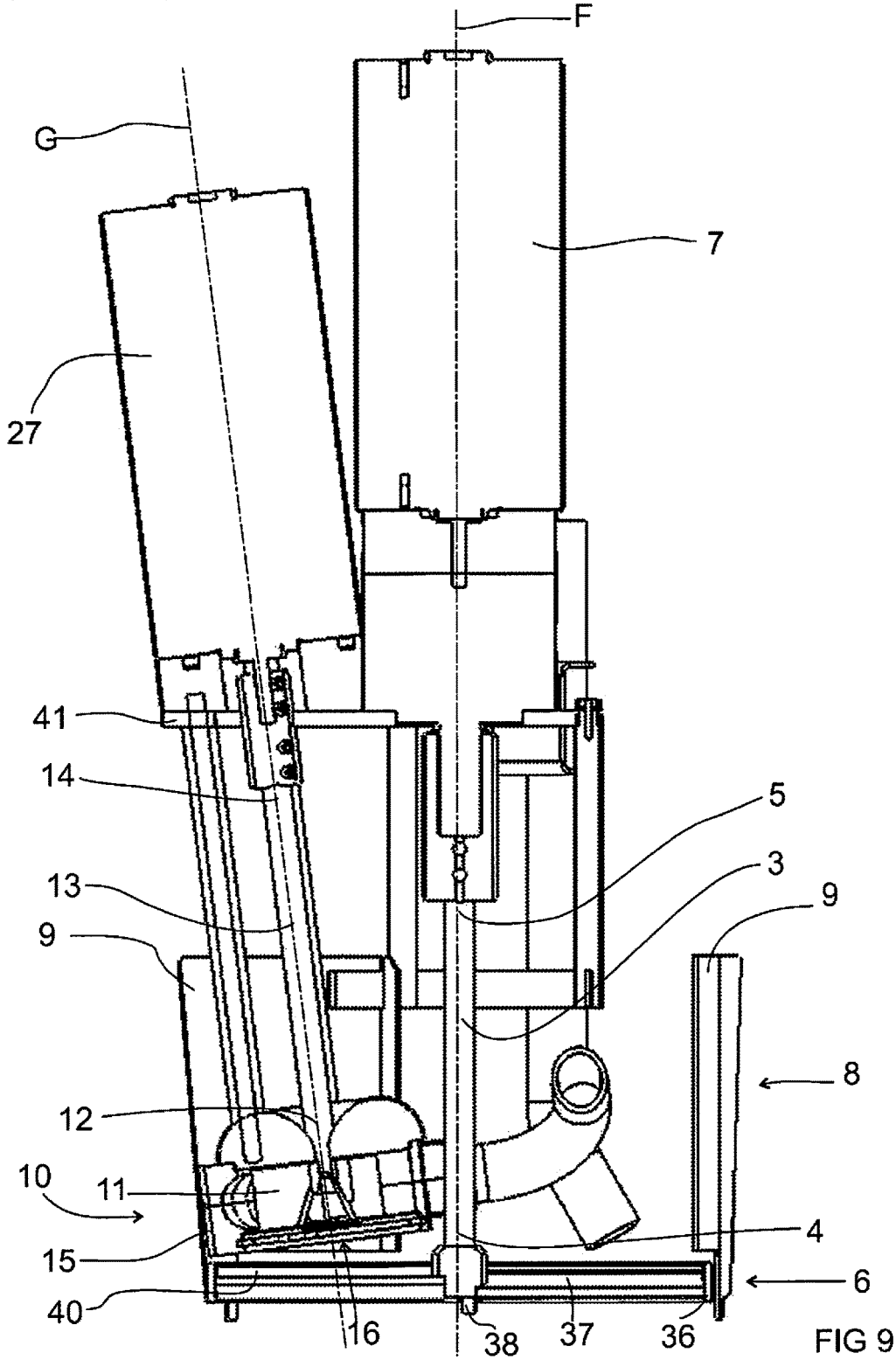
Figure 10:
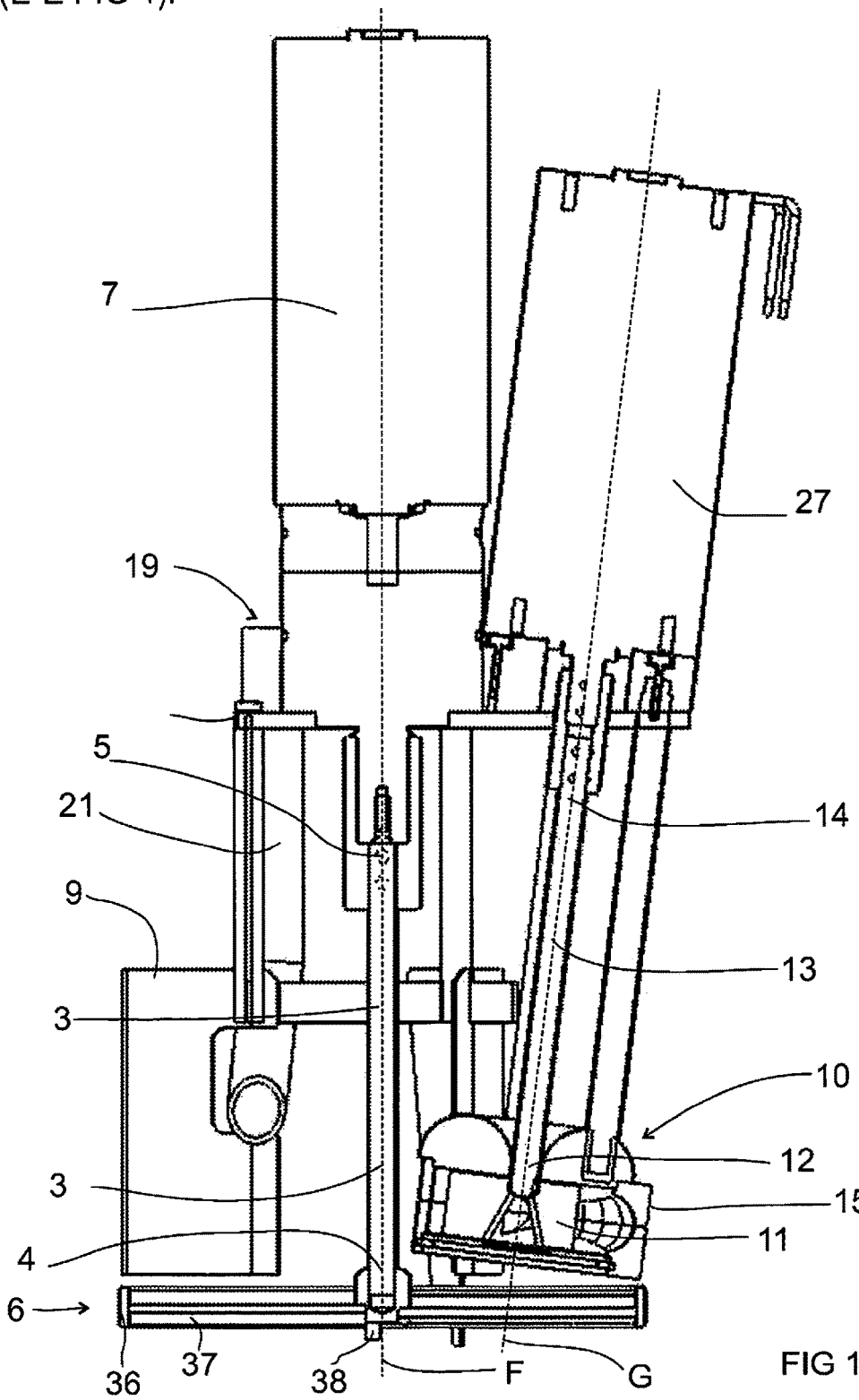
Figure 11:
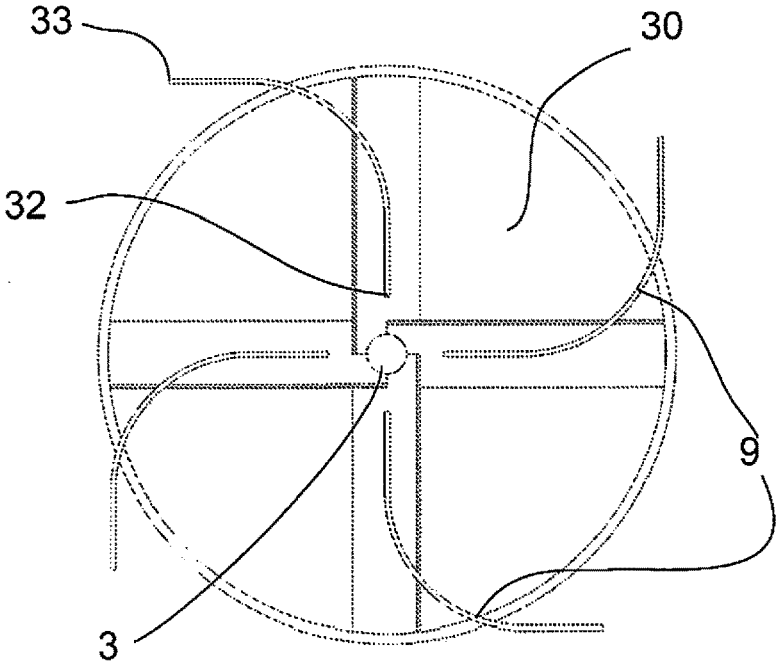
Figure 12:
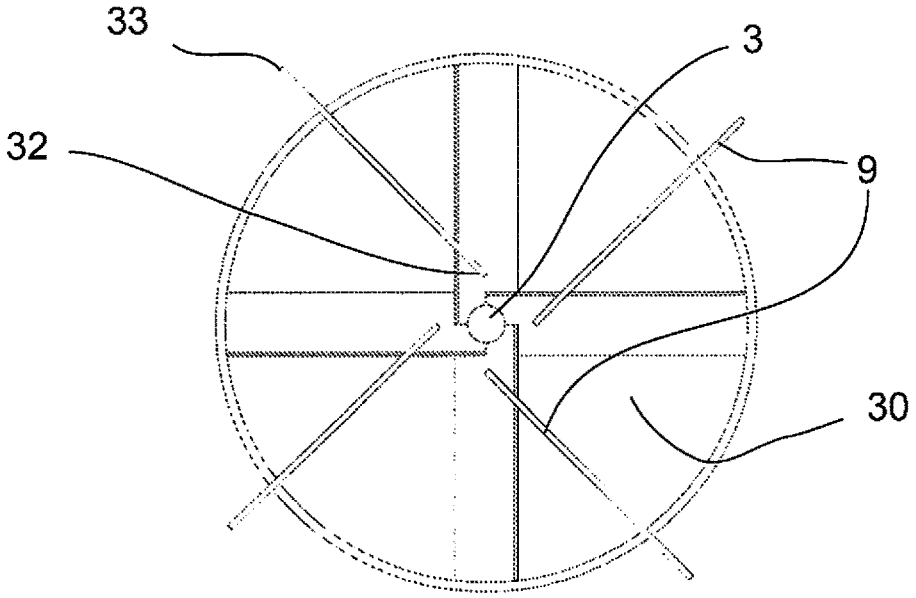
Figure 13:
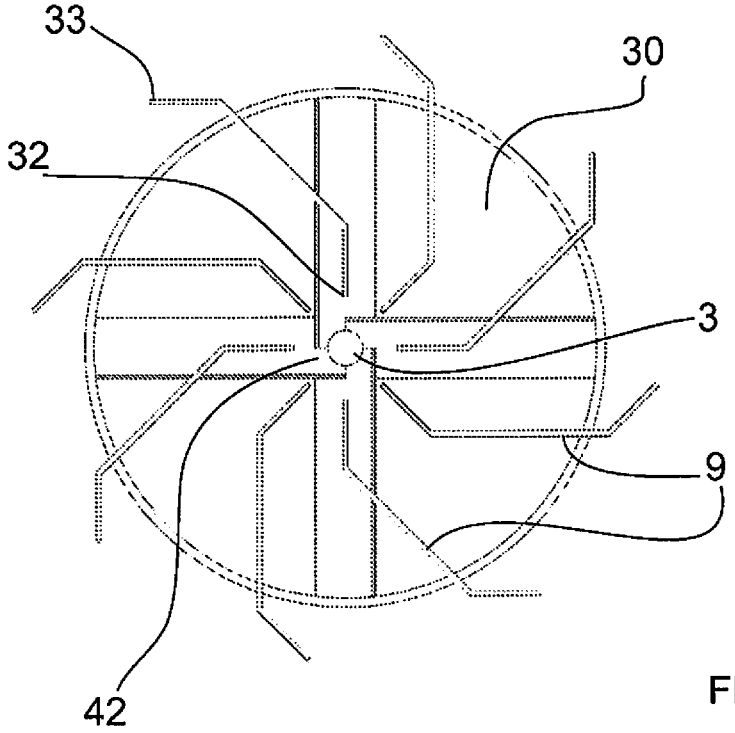
Figure 14:
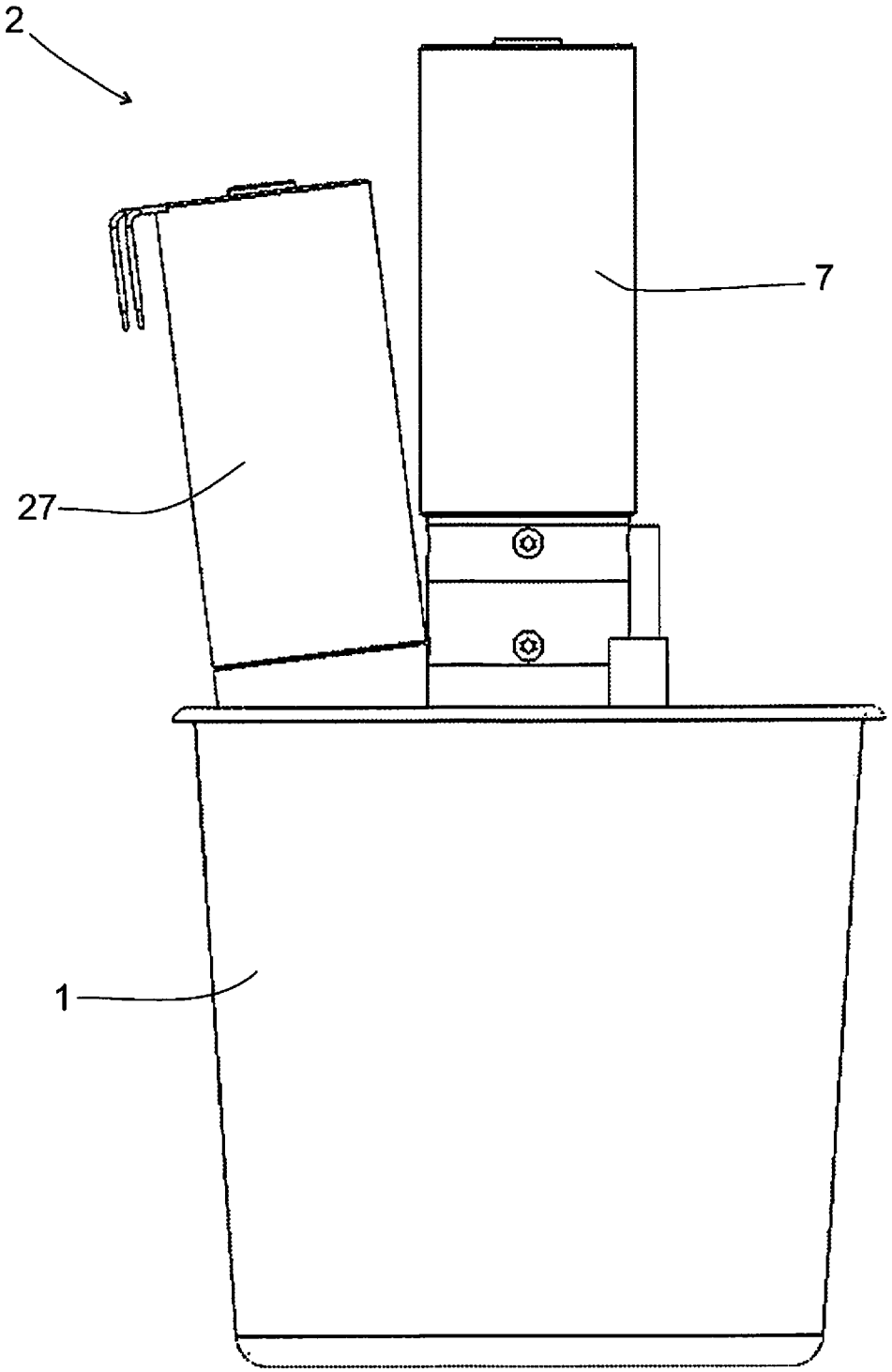
Figure 15:
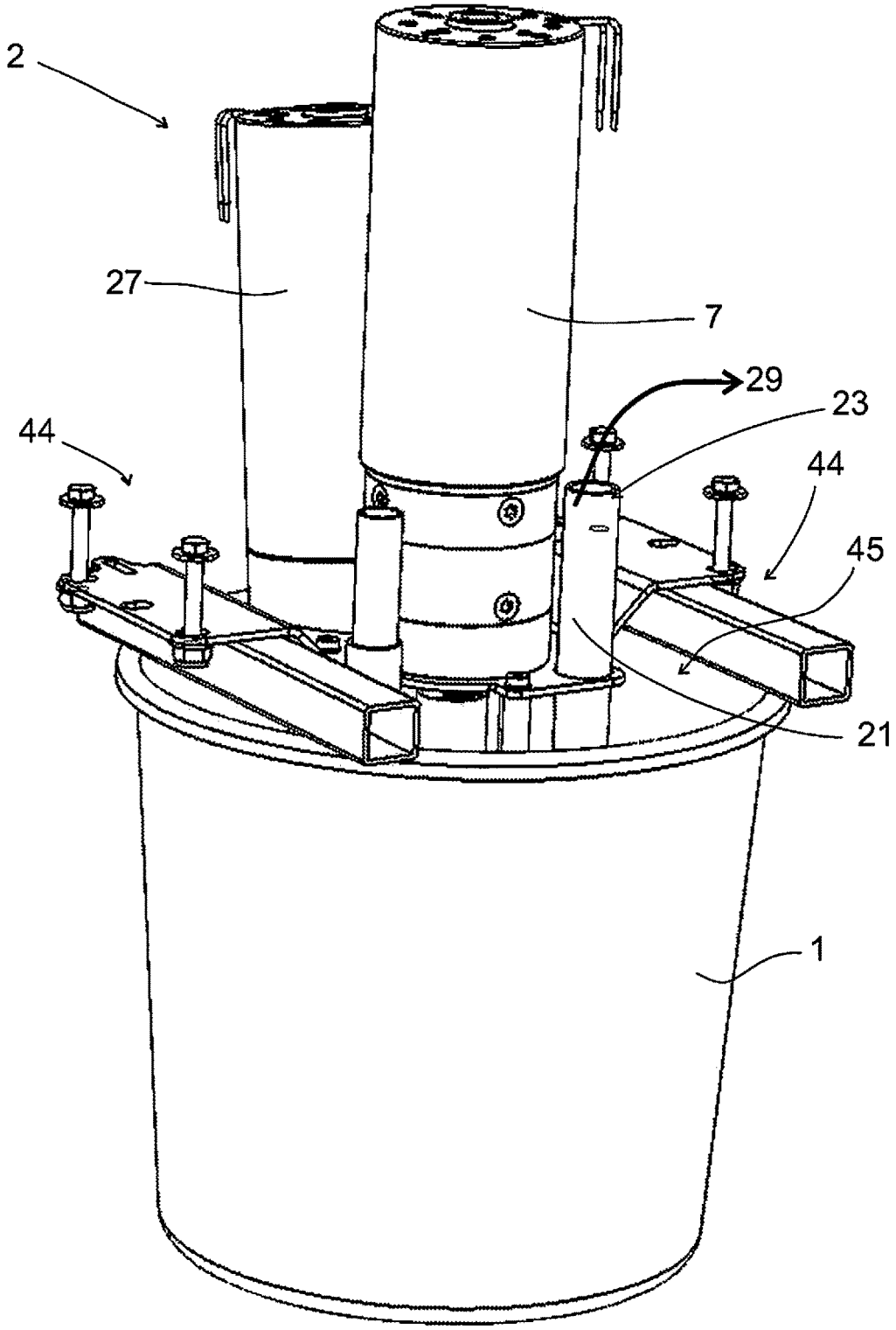
Figure 16:
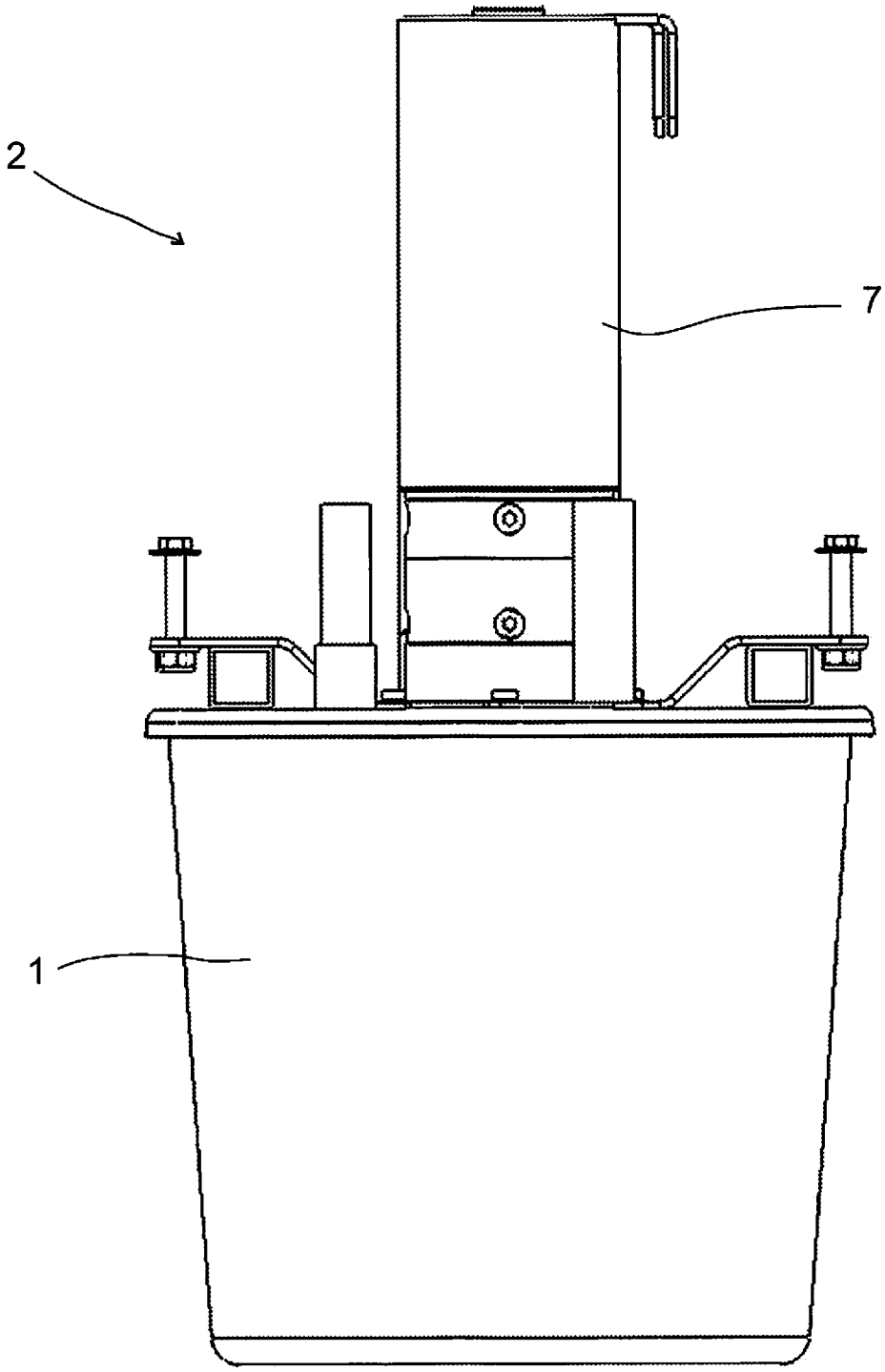
Figure 17:
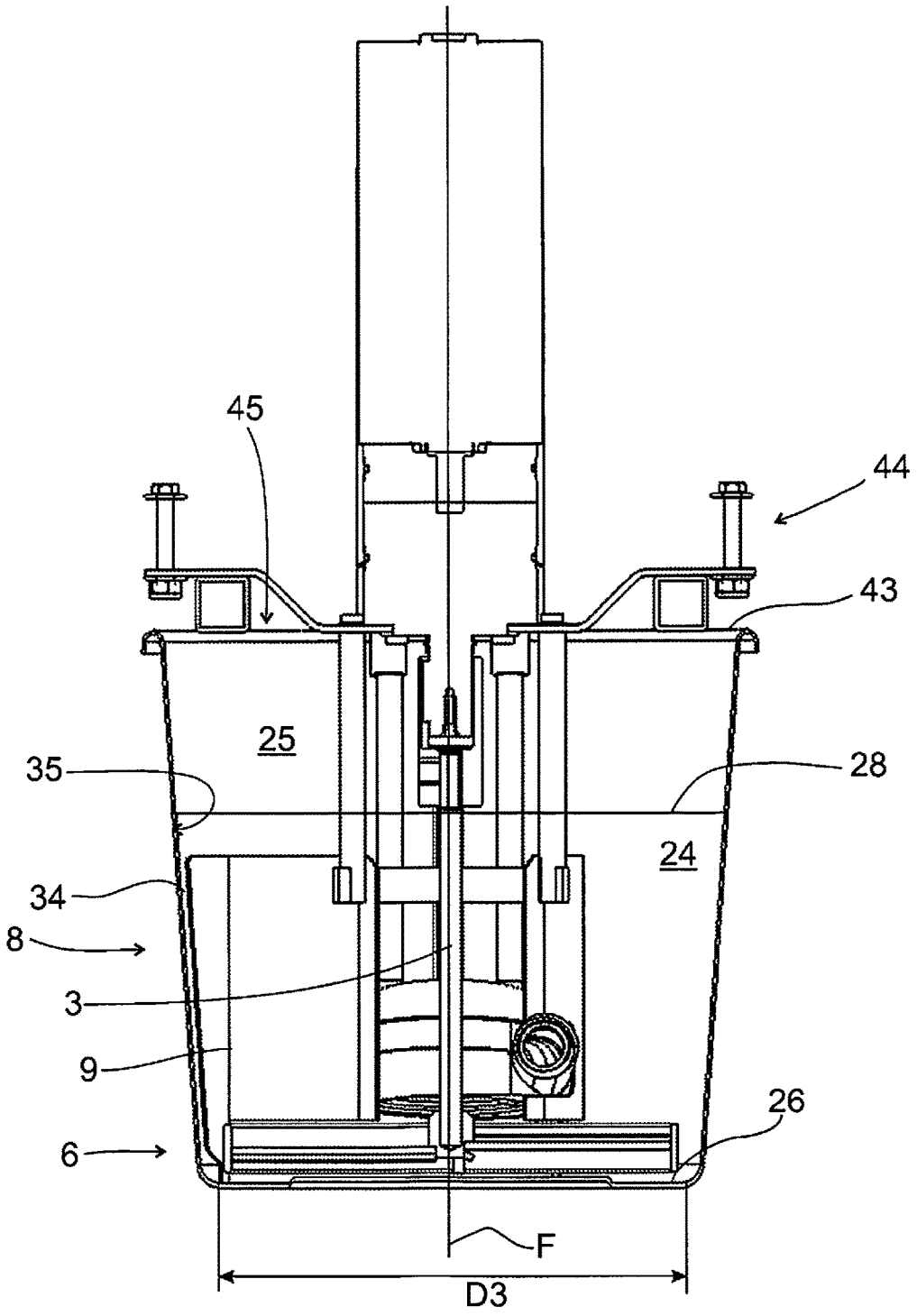
Figure 18:
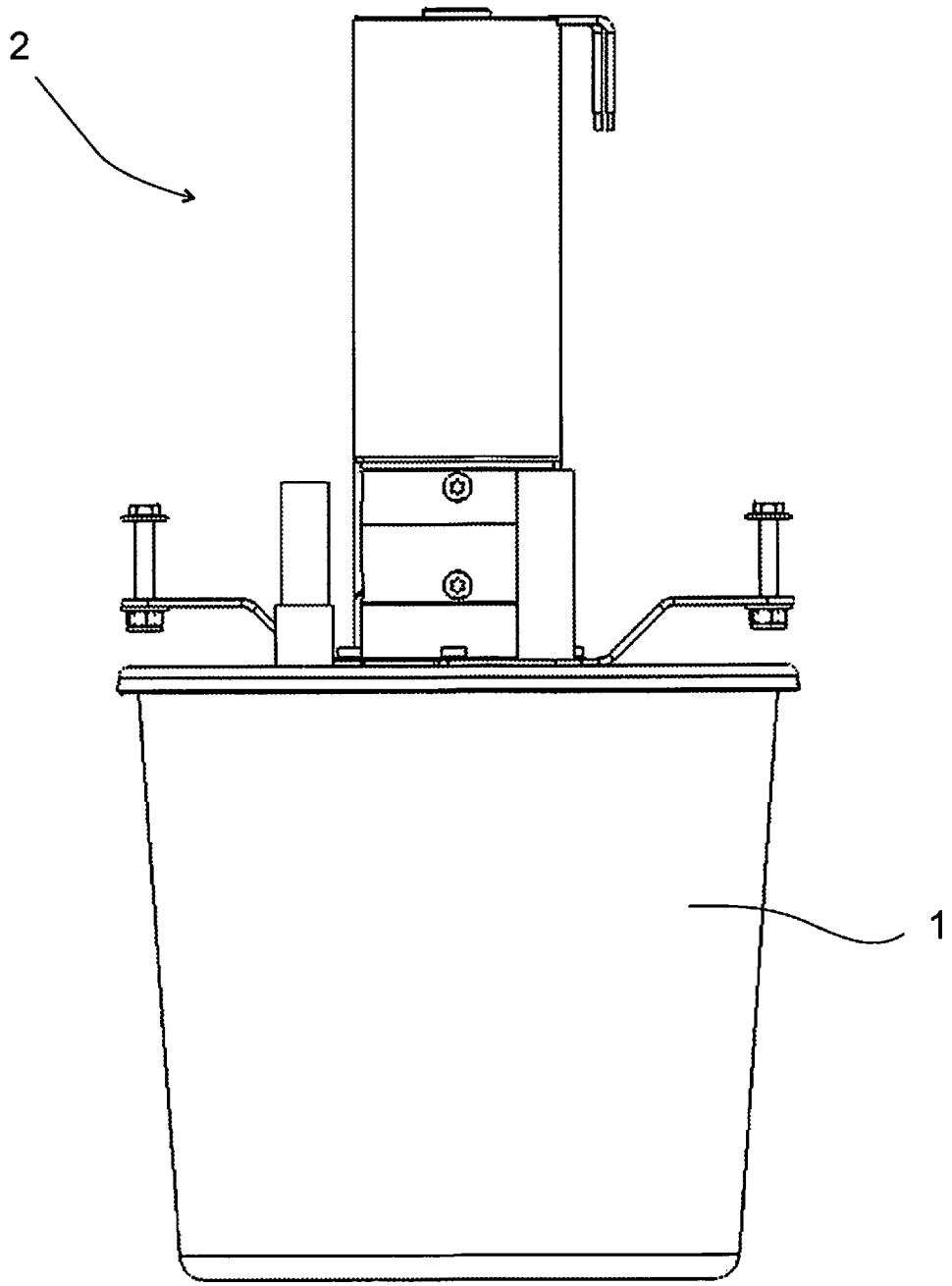
Figure 19:
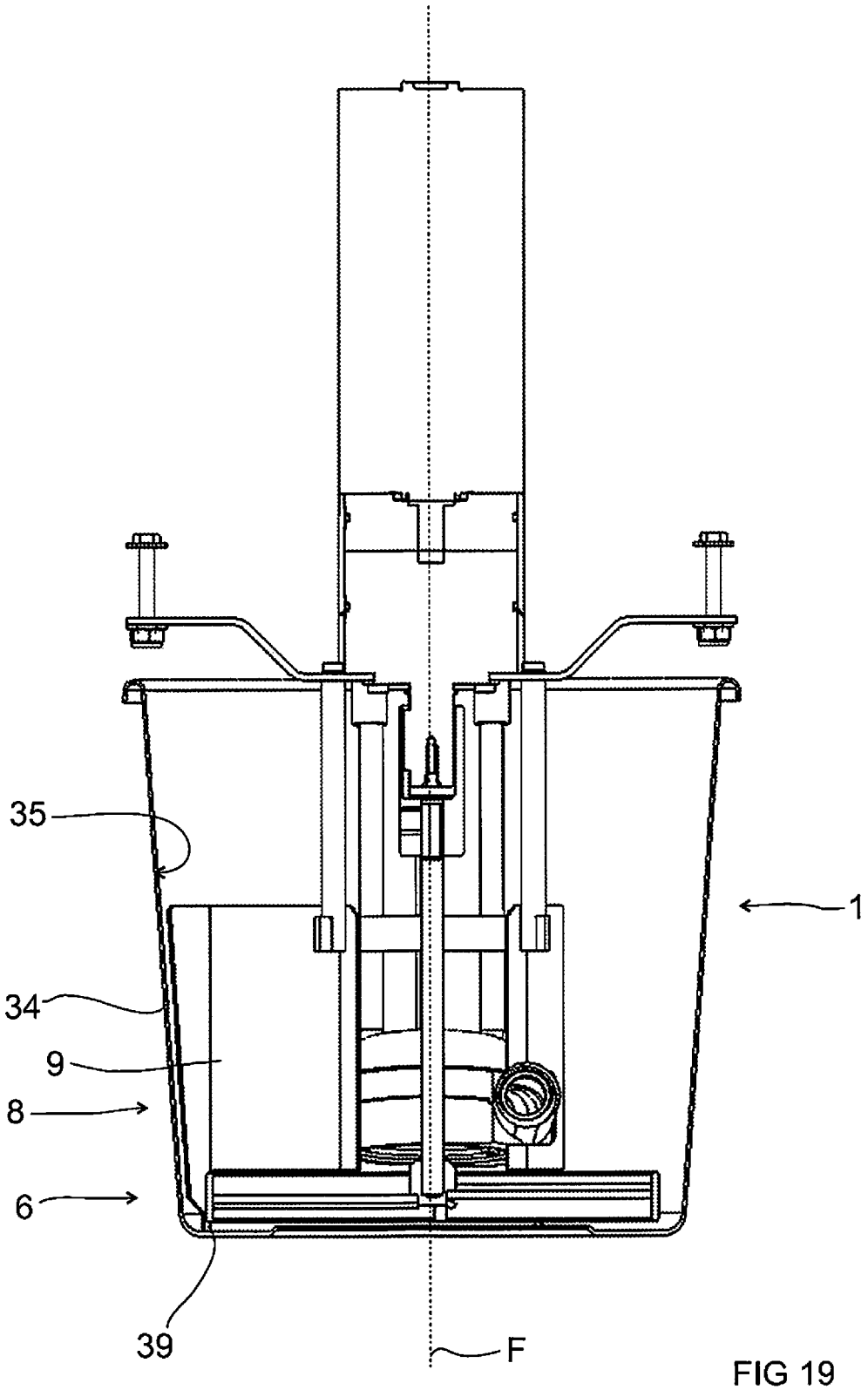

In the following the invention will described in more detail by referring to the figures, which FIG. 1 shows an embodiment of the mixing and delivery pump, FIG. 2 shows the mixing and delivery pump shown in FIG. 1 as seen from one side, FIG. 3 shows the mixing and delivery pump shown in FIG. 1 as seen from below, FIG. 4 shows the mixing and delivery pump shown in FIG. 1 as seen from above, FIG. 5 shows the mixing and delivery pump shown in FIG. 1 as cut along line A-A in FIG. 2, FIG. 6 shows the mixing and delivery pump shown in FIG. 1 as cut along line B-B in FIG. 2, FIG. 7 shows a detail of the mixing and delivery pump shown in FIG. 1, FIG. 8 shows the mixing and delivery pump shown in FIG. 1 as cut along line C-C in FIG. 2, FIG. 9 shows the mixing and delivery pump shown in FIG. 1 as cut along line D-D in FIG. 4, FIG. 10 shows the mixing and delivery pump shown in FIG. 1 as cut along line E-E in FIG. 4, FIG. 11 shows, as seen from above, an alternative configuration to parts of the stator and the rotor of the mixing and delivery pump shown in FIG. 1, FIG. 12 shows, as seen from above, an alternative configuration to parts of the stator and the rotor of the mixing and delivery pump shown in FIG. 1, FIG. 13 shows, as seen from above, an alternative configuration to parts of the stator and the rotor of the mixing and delivery pump shown in FIG. 1, FIG. 14 shows a first embodiment of the mixing and delivery arrangement, FIG. 15 shows a second embodiment of the mixing and delivery arrangement, FIG. 16 shows the mixing and delivery arrangement shown in FIG. 15 as seen from the side, FIG. 17 is a cut view of the mixing and delivery arrangement shown in FIG. 15, FIG. 18 shows a third embodiment of the mixing and delivery arrangement, and FIG. 19 is a cut view of the mixing and delivery arrangement shown in FIG. 18.

DETAILED DESCRIPTION OF THE INVENTION

First the mixing and delivery method for supplying small particles (not shown in the figures) suspended in a liquid 24 to form a slurry 29 for delivery and some embodiments and variants of the method will be described in greater detail.

The mixing and delivery method comprises a first providing step for providing a container 1 having an open top 45, and an inner bottom 26 and an inner wall limiting an inner space 25.

The mixing and delivery method comprises a second providing step for providing a mixing and delivery pump 2 having:

(i.) a first shaft 3 having a first distal end 4 and a first proximal end 5, (ii.) a rotor 6 connected to the first distal end 4 of the first shaft 3, (iii.) a first power means 7 connected to the first proximal end 5 of the first shaft 3 so that the rotor 6 is rotatable about a first rotation axis F by means of the first power means 7, (iv.) a stator 8 having stator blades 9, wherein the stator 8 coaxially surrounding the first shaft 3 and wherein the stator 8 being at least partly arranged between the first distal end 4 of the first shaft 3 and the first proximal end 5 of the first shaft 3, (v.) a pump means 10 having at least one inlet 16, which is located in a stator space 30 between two stator blades 9 of the stator 8, and an outlet 17, and (vi.) an outlet pipe 21 having a second inlet opening 22 connected to the outlet 17 of the pump means 10 and a second outlet opening 23.

The mixing and delivery method comprises a third providing step for providing in the inner space 25 of the container 1 liquid 24 having small particles suspended in the liquid 24. The small particles may have a particle size that is less than about 2 mm, preferably less than about 1 mm, more preferably less than about 0.5 mm, for example between about 0.01 mm and about 0.5 mm.

The mixing and delivery method comprises arranging the mixing and delivery pump 2 in the inner space 25 of the container 1 so that the rotor 6 is at the inner bottom 26 of the inner space 25 of the container 1, so that the first power means 7 is located outside the inner space 25 in the container 1, and so that the second outlet opening 23 of the outlet pipe 21 is located outside the inner space 25 of the container 1.

The mixing and delivery method comprises rotating said rotor 6 to mix said liquid 24 having small particles suspended in the liquid 24 to form a slurry 29.

The mixing and delivery method comprises pumping slurry 29 with said pump means 10 to deliver slurry 29 from the second outlet opening 23 of the outlet pipe 21.

The mixing and delivery method may comprise providing in the second providing step a mixing and delivery pump 2 having additionally:

(vii.) an inlet pipe 18 having a first inlet opening 19 and a first outlet opening 20, which is located at least partly in a stator space 30 between two stator blades 9, wherein the mixing and delivery method comprises arranging the mixing and delivery pump 2 in the inner space 25 of the container 1 so that the first inlet opening 19 of the inlet pipe 18 is located outside the inner space 25 of the container 1. In such case, the mixing and delivery method may comprise connecting the first inlet opening 19 of the inlet pipe 18 in fluid connection, for example via a sampling means (not shown in the figures) and/or an analyzing means (not shown in the figures), with the second outlet opening 23 of the outlet pipe 21, and returning slurry 29 delivered from the second outlet opening 23 of the outlet pipe 21 to the first inlet opening 19 of the inlet pipe 18. An effect of this is that the method may be used for supplying slurry to a sampling means and/or an analyzing means for analyzing the slurry. Another effect of this is that the method may be used for supplying slurry having uniform distribution of small particles.

The mixing and delivery method may comprise providing in the second providing step a mixing and delivery pump 2, where the pump means 10 is located in a stator space 30 between two stator blades 9 of the stator 8, wherein the pump means 10 have an impeller 11 connected to a second distal end 12 of a second shaft 13 having a second proximal end 14 connected to a second power means 27 for rotating the impeller 11 about a second rotation axis G, and wherein the pump means 10 have a pump housing 15 for housing the impeller 11, wherein the inlet 16 of the pump means 10, which is located in a stator space 30 between two stator blades 9 of the stator 8, is provided in pump housing 15 in the form of an axial inlet, and wherein the outlet 17 of the pump means 10 is provided in pump housing 15 in the form of a tangential outlet. In such case, the method comprises arranging the mixing and delivery pump 2 in the inner space 25 of the container 1 so that the second power means 27 is located outside the inner space 25 of the container 1. An effect of this is effective pumping of slurry. Another effect of this is that this provides for more space in the inner space 25 of the container 1 for the rotor 5 and the stator 8, which has a positive effect on the mixing performance of the mixing and delivery pump 2.

If the method comprises providing in the second providing step a mixing and delivery pump 2, where the pump means 10 is located in a stators space 30 between two stator blades 9 of the stator 8 and where impeller 11 of the pump means 10 is connected to a second power means 27 by means of a second shaft 13 as described above, the second rotation axis G and the first rotation axis F of the mixing and delivery pump 2 that is provided the second providing step may be arranged inclined by an inclination angle (not marked with a reference sign or numeral) that can be less than 20°, such as between 5 and 15° with respect to each other to enable both using of enough powerful i.e. large first power means 7 and second power means 27 and on the second hand to enable placing of the pump means 10 in a stator space 30 between two stator blades 9 of the stator 8.

The mixing and delivery method may comprise providing in the second providing step a mixing and delivery pump 2 comprising a support frame 41 to which the first power means 7, the possible second power means 27, the pump means 10, the possible inlet pipe 18, and the stator 8 is attached to, so that the outlet pipe is attached to the stator 8 and to the pump means 10, and so that the rotor 6 is attached by means of the first shaft 3 to the first power means 7. An effect of this is that all parts of the mixing and delivery pump 2 are directly or indirectly connected to each other, which makes using of the mixing and delivery pump 2 easier and which makes transporting of the mixing and delivery pump 2 easier to the site on which the mixing and delivery pump 2 is to be used.

The mixing and delivery method may comprise providing in the second providing step a mixing and delivery pump 2, where the stator 8 extend in a direction along the first rotation axis F a first distance, and where the rotor 6 extend in a direction along the first rotation axis F a second distance that is shorter than the first distance. An effect of this is improved mixing performance.

The mixing and delivery method may comprise providing in the second providing step a mixing and delivery pump 2, where the stator 8 have a diameter D1 that is between about 60% and about 120%, preferably between about 80% and about 115% of the diameter D2 of the rotor 6. An effect of this is improved mixing performance.

The mixing and delivery method may comprise providing in the second providing step a mixing and delivery pump 2, where at least one stator blade 9 of the stator 8 is provided with a stator support 39 for supporting the stator 8 against the inner bottom 26 of the container 1 so that a rotor space 40 is formed between the stator 8 and the inner bottom 26 of the container 1. Alternatively or additionally the mixing and delivery pump 2 may in the method be supported on a circumferential edge 43 of the container 1, which circumferential edge 43 of the container 1 surrounding the open top 45 of the container 1 so that a rotor space 40 for the rotor 6 is formed between the stator 8 and the inner bottom 26 of the container 1. In such case the method may comprise, as is shown in FIGS. 15 to 17, supporting members 44 between the circumferential edge 43 of the container 1 and the mixing and delivery pump 2. The supporting members 44 may be parts of the container 1 and/or the mixing and delivery pump 2. The height of the rotor space 40 may be at least about 102% of the height of the rotor 6, preferably between about 102% and about 400% of the rotor 6, more preferably between about 103% and about 150% of the rotor 6, such as about 105% of the height of the rotor 6, wherein the height of the rotor 6 is measured in parallel with the first rotation axis F.

The mixing and delivery method may comprise providing in the second providing step a mixing and delivery pump 2, where the rotor 6 comprise a rim member 36 that is coaxial with the first shaft 3 and where a plurality of rotor blades 37 extend between the first shaft 3 and the rim member 36, so that each rotor blade 37 is in the form of a flat elongated plate member that is tilted and/or twisted with respect to a first reference plane perpendicular to the first rotation axis F of the first shaft 3, so that each rotor blade 37 extend perpendicularly with respect to the first rotation axis F of the first shaft 3 between the first shaft 3 and the rim member 36, and so that the distance between a leading edge of each rotor blade 37 and the inner bottom 26 of the container 1 is smaller than the distance between a trailing edge of each rotor blade 37 and the inner bottom 26 of the container 1. An effect this is improved mixing performance, because the rotor 6 lifts particles, liquid and slurry from the inner bottom 26 of the container 1.

The mixing and delivery method may comprise providing in the second providing step a mixing and delivery pump 2, where the rotor 6 may comprise a mixing plate 38 on the side of the rotor 6 facing the inner bottom 26 of the container 1, wherein the mixing plate 38 extend perpendicularly with respect to the first reference plane perpendicular to the first rotation axis F of the first shaft 3. An effect of such rotor 6 is improved mixing performance, because this provides for effective mixing also on the inner bottom 26 of the container 1.

The mixing and delivery method may comprise providing in the first providing step a container 1 having an inner space 25, which has the form of a cylinder or a truncated cone, wherein the inner space 25 is axially limited by the inner bottom 26, which is circular, and radially limited by the inner wall 35. The container 1 can be in the form of a bucket. An effect of this is that with a container 1 having such configuration is improved mixing performance due to less "dead space" in the form of corners between the container 1 and the mixing and delivery pump 2. The container 1 can however also be larger or smaller than for example a 10 liter bucket.

If the mixing and delivery method may comprise providing in the first providing step a container 1 have an inner space 25, which has the form of a cylinder or a truncated cone, wherein the inner space 25 is axially limited by the inner bottom 26, which is circular, and radially limited by the inner wall 35, the mixing and delivery pump 2 may be arranged in the container 1 so that the first rotation axis F of the first shaft 3 and a central axis of the inner space 25 of the container 1 are coaxial.

If the mixing and delivery method may comprise providing in the first providing step a container 1 having an inner space 25, which has the form of a cylinder or a truncated cone, wherein the inner space 25 is axially limited by the inner bottom 26, which is circular, and radially limited by the inner wall 35, the mixing and delivery method may comprise providing in the second providing step a mixing and delivery pump 2, where the stator 8 have a diameter D1 that is between about 85 and about 100%, preferably between about 87.5 and about 97.5%, more preferably between about 90 and about 95%, such as about 92.5% of the diameter D3 of the inner bottom 26 of the container 1. An effect of this is improved mixing performance, because this prevents formations of turbulence on the inner wall 25 of the container 1.

If the mixing and delivery method may comprise providing in the first providing step a container 1 having an inner space 25, which has the form of a cylinder or a truncated cone, wherein the inner space 25 is axially limited by the inner bottom 26, which is circular, and radially limited by the inner wall 35, the mixing and delivery method may comprise providing in the second providing step a mixing and delivery pump 2, where the rotor 6 have a diameter D2 that is between about 85 and about 95%, preferably between about 87.5% and about 92.5%, more preferably between about 90% and about 92%, such as about 91% of the diameter D3 of the inner bottom 26 of the container 1. An effect of this is improved mixing performance, because the inner bottom 26 of the container 1 will be effectively mixed.

If the mixing and delivery method may comprise providing in the first providing step a container 1 have an inner space 25, which has the form of a cylinder or a truncated cone, wherein the inner space 25 is axially limited by the inner bottom 26, which is circular, and radially limited by the inner wall 35, the mixing and delivery method may comprise providing in the second providing step a mixing and delivery pump 2, wherein the stator 8 comprise a tube element 31 that is coaxial with the first shaft 3 and a plurality of stator blades 9 each being attached to the tube element 31, so that each stator blade 9 have a proximal free end 32 and a distal free end 33 so that the proximal free end 32 of the stator blades 9 being positioned at a distance from each other so that the stator 8 comprises a central open space 42 and so that the proximal free end 32 of each stator blade 9 being positioned at a distance from the inner wall 35 of the container 1 so that a slit 34 is formed between the inner wall 35 of the container 1 and each stator blade 9 of the stator 8. An effect of this is improved mixing performance, because particles, liquid, and slurry can flow between the stator 8 and the inner wall 35 of the container 1. The width of the slit 34 can for example be between 0.5 and 5 mm, preferably between 1 and 3 mm, such as about 2 mm.

In the figures, the stator 8 comprises a tube element 31 that is coaxial with the first shaft 3 and a plurality of stator blades 9 each being attached to the tube element 31 and each stator blade 9 having a proximal free end 32 and a distal free end 33.

In the figures, each stator blade 9 of the stator 8 extends perpendicularly with respect to a first reference plane perpendicular to the first rotation axis F of the first shaft 3.

In FIGS. 8 and 11, each stator blade 9 having a curved section between the proximal free end 32 and the distal free end 33 in the radial direction.

In FIGS. 8 and 11, each stator blade 9 extends perpendicularly with respect to a first reference plane perpendicular to the first rotation axis F of the first shaft 3 and each stator blade 9 having a curved section (not marked with a reference numeral) between the proximal free end 32 and the distal free end 33 in the radial direction, which curved section is curved with respect to a second reference plane parallel with the first rotation axis F of the first shaft 3.

In FIG. 9 each stator blade 9 having a first planar section (not marked with a reference numeral) between the curved section and the proximal free end 32 and a second planar section (not marked with a reference numeral) between the curved section and the distal free end 33. In the figures the first planar section of each stator blade 9 extends perpendicularly with respect to the second planar section of each stator blade 9.

In the figures, the proximal free end 32 of each stator blade 9 is positioned at a distance from each other so that the stator 8 comprises a central open space 42. An effect of this is that small particles, liquid, and slurry will flow towards the central open space 42 and collide there, which improves the mixing performance. The central open space 42 can be cylindrical and have a diameter (not marked with a reference sign or numeral) that can for example be between 5 and 90%, such as between 25 and 75, for example about 50% of the diameter D1 of the stator 8. The central open space 42 can be cylindrical and have a diameter (not marked with a reference sign or numeral) that can for example be between 25 and 200 mm, such as between 50 and 150 mm, such as between for example about 100 mm.

Next the mixing and delivery arrangement for supplying small particles suspended in a liquid 24 to form a slurry 29 for delivery and some embodiments and variants of the arrangement will be described in greater detail.

The small particles may have a particle size that is less than about 2 mm, preferably less than about 1 mm, more preferably less than about 0.5 mm, for example between about 0.01 mm and about 0.5 mm.

The mixing and delivery arrangement comprises a container 1 having an open top 45, and inner bottom 26 and an inner wall 35 limiting an inner space 25.

The mixing and delivery arrangement comprises a mixing and delivery pump 2 having:

(i.) a first shaft 3 having a first distal end 4 and a first proximal end 5, (ii.) a rotor 6 connected to the first distal end 4 of the first shaft 3 and arranged at the inner bottom 26 of the inner space 25 of the container 1, (iii.) a first power means 7 connected to the first proximal end 5 of the first shaft 3 so that the rotor 6 is rotatable about a first rotation axis F by means of the first power means 7, wherein the first power means 7 is located outside the inner space 25 of the container 1, (iv.) a stator 8 having stator blades 9, wherein the stator 8 coaxially surrounding the first shaft 3 and wherein the stator 8 being arranged at least partly between the first distal end 4 of the first shaft 3 and the proximal end of the first shaft 3, (v.) a pump means 10 having at least one inlet 16, which is located in a stator space 30 between two stator blades 9 of the stator 8, and an outlet 17, and (vi.) an outlet pipe 21 having a second inlet opening 22 connected to the outlet 17 of the pump means 10 and a second outlet opening 23 located outside the inner space 25 of the container 1.

The pump means 10 of the mixing and delivery pump 2 may be located in a stator space 30 between two stator blades 9 of the stator 8, so that pump means 10 have an impeller 11 connected to a second distal end 12 of a second shaft 13 having a second proximal end 14 connected to a second power means 27 for rotating the impeller 11 about a second rotation axis (G), and so that pump means 10 have a pump housing 15 for housing the impeller 11, wherein the inlet 16, which is located in a stator space 30 between two stator blades 9 of the stator 8, is provided in pump housing 15 in the form of an axial inlet, and wherein the outlet 17 of the pump means 10 is provided in pump housing 15 in the form of a tangential outlet. In such case, the second power means 27 is located outside the inner space 25 of the container 1. An effect of this is effective pumping of slurry. Another effect of this is that because the second power means 27 is located outside the inner space 25 of the container 1, this provides for more space in the inner space 25 of the container 1 for the rotor 5 and the stator 8, which has a positive effect on the mixing performance of the mixing and delivery pump 2. In such case, the distance between the rotor 6 and the inlet of the pump housing 15 may be between about 10 and about 20%, preferably about 15% of the diameter D2 of the rotor 6, wherein the distance is measured in parallel with the first rotation axis F.

If the pump means 10 is located in a stators space 30 between two stator blades 9 of the stator 8 and if impeller 11 of the pump means 10 of the mixing and delivery pump 2 is connected to a second power means 27 by means of a second shaft 13 as described above, the second rotation axis G and the first rotation axis F of the mixing and delivery pump 2 may be arranged inclined by an inclination angle (not marked with a reference sign or numeral) that can be less than 20°, such as between 5 and 15° with respect to each other to enable both using of enough powerful i.e. large first power means 7 and second power means 27 and on the second hand to enable placing of the pump means 10 in a stator space 30 between two stator blades 9 of the stator 8.

The pump means 10 of the mixing and delivery pump 2 may additionally have:

(vii.) an inlet pipe 18 having a first inlet opening 19 located outside the inner space 25 of the container 1 and a first outlet opening 20 located at least partly in a stator space 30 between two stator blades 9. In such case, the first inlet opening 19 of the inlet pipe 18 may be in fluid connection, for example via a sampling means (not shown in the figures) and/or an analyzing means (not shown in the figures), with the second outlet opening 23 of the outlet pipe 21, for returning slurry 29 delivered from the second outlet opening 23 of the outlet pipe 21 to the first inlet opening 19 of the inlet pipe 18. An effect of this is that the arrangement may be used for supplying slurry to a sampling means and/or an analyzing means for analyzing the slurry. Another effect of this is that the arrangement can be used for supplying slurry having uniform distribution of small particles therein.

In the mixing and delivery arrangement, the first outlet opening 20 of the possible inlet pipe 18 may be located in a stator space 30 between two stator blades 9, which stator space 30 is next to the stator space 30 in which the pump means 10 is located in and which stator space 30 is after the stator space 30 in which the pump means 10 is located in with respect to the rotation of the rotor 6 about the first rotation axis F. An effect of this is that the liquid and the small particles contained in the liquid will have time to mix before entering the pump means 10.

The mixing and delivery arrangement may comprise a support frame 41 to which the first power means 7, the possible second power means 27, the pump means 10, the possible inlet pipe 18, and the stator 8 is attached to, so that the outlet pipe 21 is attached to the stator 8 and to the pump means 10, and so that the rotor 6 is attached by means of the first shaft 3 to the first power means 7. An effect of this is that all parts of the mixing and delivery pump 2 are directly or indirectly connected to each other, which makes using of the mixing and delivery pump 2 easier and which makes it easier to transport the mixing and delivery pump 2 to the site on which it is to be used.

In the mixing and delivery arrangement, the stator 8 may extend in a direction along the first rotation axis F a first distance, and the rotor 6 may extend in a direction along the first rotation axis F a second distance that is shorter than the first distance. An effect of this is improved mixing performance.

In the mixing and delivery arrangement, the stator 8 may have a diameter D1 that is between about 60 and about 120%, preferably between about 80 and about 115% of the diameter D2 of the rotor 6. An effect of this is improved mixing performance.

In the mixing and delivery arrangement, at least one stator blade 9 of the stator 8 may be provided with a stator support 39 for supporting the stator 8 against the inner bottom 26 of the container 1 so that a rotor space 40 is formed between the stator 8 and the inner bottom 26 of the container 1. Alternatively or additionally the mixing and delivery pump 2 may in the arrangement be supported on a circumferential edge 43 of the container 1, which circumferential edge 43 of the container 1 surrounding an open end of the container 1 so that a rotor space 40 for the rotor 6 is formed between the stator 8 and the inner bottom 26 of the container 1. In such case the arrangement may comprise, as is shown in FIGS. 15 to 17, supporting members 44 between the circumferential edge 43 of the container 1 and the mixing and delivery pump 2. The supporting members 44 may be parts of the container 1 and/or the mixing and delivery pump 2. The height of the rotor space 40 may be at least about 102% of the height of the rotor 6, preferably between about 102% and about 400% of the rotor 6, more preferably between about 103% and about 150% of the rotor 6, such as about 105% of the height of the rotor 6, wherein the height of the rotor 6 is measured in parallel with the first rotation axis F. An effect of this is improved volume of mixed slurry.

In the mixing and delivery arrangement, the rotor 6 may comprise a rim member 36 that is coaxial with the first shaft 3 and a plurality of rotor blades 37 extending between the first shaft 3 and the rim member 36, so that each rotor blade 37 is in the form of a flat elongated plate member that is tilted and/or twisted with respect to a first reference plane perpendicular to the first rotation axis F of the first shaft 3, so that each rotor blade 37 extend perpendicularly with respect to the first rotation axis F of the first shaft 3 between the first shaft 3 and the rim member 36, and so that the distance between a leading edge of each rotor blade 37 and the inner bottom 26 of the container 1 is smaller than the distance between a trailing edge of each rotor blade 37 and the inner bottom 26 of the container 1. An effect of this is improved mixing performance, because the rotor 6 lifts particles, liquid, and slurry from the inner bottom 26 of the container 1.

In the mixing and delivery arrangement, the rotor 6 may comprise a mixing plate 38 on the side of the rotor 6 facing the inner bottom 26 of the container 1, wherein the mixing plate 38 extend perpendicularly with respect to the first reference plane perpendicular to the first rotation axis F of the first shaft 3. An effect of this is improved mixing performance, because this provided for effective mixing also on the inner bottom 26 of the container 1.

In the mixing and delivery arrangement, the container 1 have an inner space 25, which has the form of a cylinder or a truncated cone, wherein the inner space 25 is axially limited by the inner bottom 26, which is circular, and radially limited by the inner wall 35. The container 1 can be in the form of a bucket. An effect of this is improved mixing performance due to less "dead space" in the form of corners between the container 1 and the mixing and delivery pump 2. The container 1 can however also be larger or smaller than for example a 10 liter bucket.

If the container 1 have an inner space 25, which has the form of a cylinder or a truncated cone, wherein the inner space 25 is axially limited by the inner bottom 26, which is circular, and radially limited by the inner wall 35, the mixing and delivery pump 2 may be arranged in the container 1 so that the first rotation axis F of the first shaft 3 and a central axis of the container 1 are coaxial. An effect of this is improved mixing performance.

If the container 1 have an inner space 25, which has the form of a cylinder or a truncated cone, wherein the inner space 25 is axially limited by the inner bottom 26, which is circular, and radially limited by the inner wall 35, the stator 8 may have a diameter D1 that is between about 85 and about 100%, preferably between about 87.5 and about 97.5%, more preferably between about 90 and about 95%, such as about 92.5% of the diameter D3 of the inner bottom 26 of the container 1. An effect of this is improved mixing performance, because this prevents formation of turbulence on the inner wall 35 of the container 1.

If the container 1 have an inner space 25, which has the form of a cylinder or a truncated cone, wherein the inner space 25 is axially limited by the inner bottom 26, which is circular, and radially limited by the inner wall 35, the rotor 6 may have a diameter D2 that is between about 85 and about 95%, preferably between about 87.5% and about 92.5%, more preferably between about 90% and about 92%, such as about 91% of the diameter D3 of the inner bottom 26 of the container 1. An effect of this is improved mixing performance, because the inner bottom 26 of the container 1 will be effectively mixed.

If the container 1 have an inner space 25, which has the form of a cylinder or a truncated cone, wherein the inner space 25 is axially limited by the inner bottom 26, which is circular, and radially limited by the inner wall 35, the stator 8 may comprise a tube element 31 that is coaxial with the first shaft 3 and a plurality of stator blades 9 each being attached to the tube element 31, wherein each stator blade 9 have a proximal free end 32 and a distal free end 33 so that the proximal free end 32 of the stator blades 9 is positioned at a distance from each other so that the stator 8 comprises a central open space 42 and so that the proximal free end 32 of each stator blade 9 is positioned at a distance from the inner wall 35 of the container 1 so that a slit 34 is formed between the inner wall 35 of the container 1 and each stator blade 9 of the stator 8. An effect of this is improved mixing performance, because particles, liquid, and slurry can flow between the stator 8 and the inner wall 35 of the container 1. The central open space 42 can be cylindrical and have a diameter (not marked with a reference sign or numeral) that can for example be between 5 and 90%, such as between 25 and 75, for example about 50% of the diameter D1 of the stator 8. The central open space 42 can be cylindrical and have a diameter (not marked with a reference sign or numeral) that can for example be between 25 and 200 mm, such as between 50 and 150 mm, such as between for example about 100 mm.

In the figures, the stator 8 comprises a tube element 31 that is coaxial with the first shaft 3 and a plurality of stator blades 9 each being attached to the tube element 31 and each stator blade 9 having a proximal free end 32 and a distal free end 33.

In the figures, each stator blade 9 of the stator 8 extends perpendicularly with respect to a first reference plane perpendicular to the first rotation axis F of the first shaft 3.

In FIGS. 8 and 11, each stator blade 9 having a curved section between the proximal free end 32 and the distal free end 33 in the radial direction.

In FIGS. 8 and 11, each stator blade 9 extends perpendicularly with respect to a first reference plane perpendicular to the first rotation axis F of the first shaft 3 and each stator blade 9 having a curved section (not marked with a reference numeral) between the proximal free end 32 and the distal free end 33 in the radial direction, which curved section is curved with respect to a second reference plane parallel with the first rotation axis F of the first shaft 3.

In FIG. 13 each stator blade 9 having a first planar section (not marked with a reference numeral) between the curved section and the proximal free end 32 and a second planar section (not marked with a reference numeral) between the curved section and the distal free end 33. In the figures the first planar section of each stator blade 9 extends perpendicularly with respect to the second planar section of each stator blade 9.

In the figures, the proximal free end 32 of each stator blade 9 is positioned at a distance from each other so that the stator 8 comprises a central open space 42. An effect of this is that small particles, liquid, and slurry will flow towards the central open space 42 and collide there, which improves the mixing performance. The central open space 42 can be cylindrical and have a diameter (not marked with a reference sign or numeral) that can for example be between 5 and 90%, such as between 25 and 75, for example about 50% of the diameter D1 of the stator 8. The central open space 42 can be cylindrical and have a diameter (not marked with a reference sign or numeral) that can for example be between 25 and 200 mm, such as between 50 and 150 mm, such as between for example about 100 mm.

Next the mixing and delivery pump 2 for supplying small particles suspended in a liquid 24 contained in a container 1 to form a slurry 29 for delivery and some embodiments and variants of the mixing and delivery pump will be described in greater detail.

The small particles may have a particle size that is less than about 2 mm, preferably less than about 1 mm, more preferably less than about 0.5 mm, for example between about 0.01 mm and about 0.5 mm.

The mixing and delivery pump 2 comprises:

(i.) a first shaft 3 having a first distal end 4 and a first proximal end 5, (ii.) a rotor 6 connected to the first distal end 4 of the first shaft 3, (iii.) a first power means 7 connected to the first proximal end 5 of the first shaft 3 so that the rotor 6 is rotatable about a first rotation axis F by means of the first power means 7, (iv.) a stator 8 having stator blades 9, wherein the stator 8 coaxially surrounding the first shaft 3 and wherein the stator 8 being arranged at least partly between the first distal end 4 of the first shaft 3 and the proximal end of the first shaft 3, (v.) a pump means 10 having at least one inlet 16, which is located in a stator space between two stator blades 9 of the stator, and an outlet 17, and (vi.) an outlet pipe 21 having a second inlet opening 22 connected to the outlet 17 of the pump means 10 and a second outlet opening 23 located at a level of the first power means 7.

The mixing and delivery pump may comprise additionally:

(vii.) an inlet pipe 18 having a first inlet opening 19 located at a level of the first power means 7 and a first outlet opening 20 located at least partly in a stator space 30 between two stator blades 9.

The outlet of the possible inlet pipe 18 may be located in a stator space 30 between two stator blades 9, which stator space 30 is next to the stator space 30 in which the pump means 10 is located in and which stator space 30 is after the stator space 30 in which the pump means 10 is located in with respect to the rotation of the rotor 6 about the first rotation axis F.

In the mixing and delivery pump, the pump means 10 may be located in a stator space 30 between two stator blades 9 of the stator 8, wherein the pump means 10 have an impeller 11 connected to a second distal end 12 of a second shaft 13 having a second proximal end 14 connected to a second power means 27 for rotating the impeller 11 about a second rotation axis G, and a pump housing 15 for housing the impeller 11, wherein the inlet 16, which is located in a stator space 30 between two stator blades 9 of the stator 8, is provided in pump housing 15 in the form of an axial inlet, and wherein the outlet 17 of the pump means 10 is provided in pump housing 15 in the form of a tangential outlet. In such case, the distance between the rotor 6 and the inlet 16 of the pump housing 15 may be between about 1 and about 35%, preferably about 15% of the diameter D2 of the rotor 6, wherein the distance is measured in parallel with the first rotation axis F. Another effect of this is that this provides for more space for the rotor 5 and the stator 8, which has a positive effect on the mixing performance of the mixing and delivery pump 2.

If the pump means 10 is located in a stators space 30 between two stator blades 9 of the stator 8 and if the impeller 11 of the pump means 10 of the mixing and delivery pump 2 is connected to a second power means 27 by means of a second shaft 13 as described above, the second rotation axis G and the first rotation axis F of the mixing and delivery pump 2 may be arranged inclined by an inclination angle (not marked with a reference sign or numeral) that can be less than 20°, such as between 5 and 15° with respect to each other to enable both using of enough powerful i.e. large first power means 7 and second power means 27 and on the second hand to enable placing of the pump means 10 in a stator space 30 between two stator blades 9 of the stator 8.

The mixing and delivery pump may comprise a support frame 41 to which the first power means 7, the possible second power means 27, the pump means 10, the possible inlet pipe 18, and the stator 8 is attached to, so that the outlet pipe 21 is attached to the stator 8 and to the pump means 10, and so that the rotor 6 is attached by means of the first shaft 3 to the first power means 7. An effect of this is that all parts of the mixing and delivery pump 2 are directly or indirectly connected to each other, which makes using of the mixing and delivery pump 2 easier and which makes transporting of the mixing and delivery pump 2 easier to the site on which the mixing and delivery pump 2 is to be used.

In the mixing and delivery pump, the stator 8 may extend in a direction along the first rotation axis F a first distance, and the rotor 6 may extend in a direction along the first rotation axis F a second distance that is shorter than the first distance. An effect of this is improved mixing performance.

The stator 8 may have a diameter D1 that is between about 85 and about 100%, preferably between about 87.5 and about 97.5%, more preferably between about 90 and about 95%, such as about 92.5% of the diameter D2 of the rotor 6. An effect of this is improved mixing performance.

At least one stator blade 9 of the stator 8 may be provided with a stator support 39 for supporting the stator 8 against an inner bottom 26 of an inner space of a container 1 so that a rotor space 40 is formed between the stator 8 and the inner bottom 26 of the container 1.

The distance between the rotor 6 and the stator 8 may be less than the of the height of the rotor 6, preferably less than 50% of the height of the rotor 6, wherein the distance is measured in parallel with the first rotation axis F. An effect of this is improved mixing performance.

The mixing and delivery pump 2 has preferably, but not necessarily, a weight that is less than 35 kg, preferably between 5 kg and 35 kg. An effect of this is easy transporting the mixing and delivery pump to the site where it is to be used. Said weight does not necessarily contain power supplying means (not shown) needed for supplying power to the mixing and delivery pump 2.

It is apparent to a person skilled in the art that as technology advanced, the basic idea of the invention can be implemented in various ways. The invention and its embodiments are therefore not restricted to the above examples, but they may vary within the scope of the claims.

LIST OF REFERENCE NUMERALS

1. container
2. mixing and delivery pump
3. first shaft
4. first distal end
5. first proximal end
6. rotor
7. first power means

8. stator
9. stator blades
10. pump means
11. impeller
12. second distal end
13. second shaft
14. second proximal end
15. pump housing
16. inlet
17. outlet
18. inlet pipe
19. first inlet opening
20. first outlet opening
21. outlet pipe
22. second inlet opening
23. second outlet opening
24. liquid
25. inner space
26. inner bottom
27. second power means
28. liquid surface
29. slurry
30. stator space
31. tube element
32. proximal free end
33. distal free end
34. slit
35. inner wall
36. rim member
37. rotor blade
38. mixing plate
39. stator support
40. rotor space
41. support frame
42. central open space
43. circumferential edge
44. supporting members
45. open top

The invention claimed is:

1. A mixing and delivery arrangement for supplying small particles suspended in a liquid to form a slurry for delivery, the mixing and delivery arrangement comprising:

a container having an open top, an inner bottom and an inner wall limiting an inner space;

a mixing and delivery pump having:

a first shaft having a first distal end and a first proximal end;

a rotor connected to the first distal end of the first shaft and arranged at the inner bottom of the inner space of the container;

a first power device connected to the first proximal end of the first shaft so that the rotor is rotatable about a first rotation axis by means of the first power device, wherein the first power device is located outside the inner space of the container;

a stator having stator blades, wherein the stator coaxially surrounding the first shaft and wherein the stator being arranged at least partly between the first distal end of the first shaft and the proximal end of the first shaft;

a pump having at least one inlet, which is located in a stator space between two stator blades of the stator, and an outlet; and an outlet pipe having a second inlet opening connected to the outlet of the pump and a second outlet opening located outside the inner space of the container;

wherein the rotor comprises a rim member that is coaxial with the first shaft and a plurality of rotor blades extending between the first shaft and the rim member, each rotor blade being in the form of a flat elongated plate member that is tilted and/or twisted with respect to a first reference plane perpendicular to the first rotation axis of the first shaft, each rotor blade extending perpendicularly with respect to the first rotation axis of the first shaft between the first shaft and the rim member, wherein the distance between a leading edge of each rotor blade and the inner bottom of the container being smaller than the distance between a trailing edge of each rotor blade and the inner bottom of the container, wherein the container comprises an inner space, which has the form of a cylinder or a truncated cone, wherein the inner space is axially limited at one end by the inner bottom, which is circular, and radially limited by the inner wall, and the rotor has a diameter that is between about 85% and about 95% of the diameter of the inner bottom of the container, wherein the pump of the mixing and delivery pump is located in the stator space between two stator blades of the stator, the pump having an impeller connected to a second distal end of a second shaft having a second proximal end connected to a second power device for rotating the impeller about a second rotation axis, and wherein the pump has a pump housing for housing the impeller, wherein the inlet, which is located in a stator space between two stator blades of the stator, is provided in the pump housing in the form of an axial inlet, and wherein the outlet of the pump is provided in the pump housing in the form of a tangential outlet, wherein the second power device is located outside the inner space of the container.

2. A mixing and delivery pump for supplying small particles suspended in liquid contained in a container to form a slurry for delivery, the mixing and delivery pump comprising:

a first shaft having a first distal end and a first proximal end;

a rotor connected to the first distal end of the first shaft;

a first power device connected to the first proximal end of the first shaft so that the rotor is rotatable about a first rotation axis by means of the first power device;

a stator having stator blades, wherein the stator coaxially surrounds the first shaft and wherein the stator is arranged at least partly between the first distal end of the first shaft and the proximal end of the first shaft;

a pump having at least one inlet which is located in a stator space between two stator blades of the stator, and an outlet;

an inlet pipe having a first inlet opening located at a level of the first power device and a first outlet opening located at least partly in a stator space between two stator blades; and an outlet pipe having a second inlet opening connected to the outlet of the pump and a second outlet opening located at a level of the first power means, wherein the pump includes an impeller connected to a second distal end of a second shaft having a second proximal end connected to a second power device for rotating the impeller about a second rotation axis, wherein the pump has a pump housing for housing the impeller, wherein the inlet is provided in the pump housing in the form of an axial inlet, and wherein the outlet of the pump is provided in the pump housing in the form of a tangential outlet.

3. The mixing and delivery pump according to claim 2, further comprising:

an inlet pipe having a first inlet opening located at a level of the first power device and a first outlet opening at least partly in a stator space between two stator blades.

4. The mixing an delivery pump according to claim 2, wherein the stator extends in a direction along the first rotation axis a first distance and the rotor extends in a direction along the first rotation axis a second distance that is shorter than the first distance.

5. The mixing an delivery pump according to claim 2, wherein the stator has a diameter that is between about 85% and about 100% of the diameter of the rotor.

6. The mixing and delivery pump according to claim 2, wherein the distance between the rotor and the inlet of the pump housing is between about 1% and about 35% of the diameter of the rotor, wherein the distance is measured in parallel with the first rotation axis.

7. The mixing and delivery pump according to claim 2, wherein the mixing and delivery pump has a weight that is less than 35 kilograms.

* * * * *